US006720122B1

(12) United States Patent
Ogawa

(10) Patent No.: US 6,720,122 B1
(45) Date of Patent: Apr. 13, 2004

(54) TONER FOR DEVELOPING STATIC CHARGE IMAGE AND METHOD FOR PREPARATION THEREOF

(75) Inventor: Tokudai Ogawa, Kawasaki (JP)

(73) Assignee: Zeon Corp., Tokyo (JP)

( * ) Notice: Subject to any disclaimer, the term of this patent is extended or adjusted under 35 U.S.C. 154(b) by 0 days.

(21) Appl. No.: 09/926,829

(22) PCT Filed: Jun. 28, 2000

(86) PCT No.: PCT/JP00/04247

§ 371 (c)(1),
(2), (4) Date: Apr. 1, 2002

(87) PCT Pub. No.: WO01/01200

PCT Pub. Date: Jan. 4, 2001

(30) Foreign Application Priority Data

Jun. 28, 1999 (JP) ..... 11-181999

(51) Int. Cl.[7] ..... G03G 9/097

(52) U.S. Cl. ..... 430/108.4; 430/110.2; 430/137.11; 430/137.17

(58) Field of Search ..... 430/110.2, 108.4, 430/108.8, 137.12, 137.17, 137.11

(56) References Cited

U.S. PATENT DOCUMENTS 4,143,024 A * 3/1979 Adelmann et al. ..... 260/31.2
5,510,222 A 4/1996 Inaba et al.
5,604,072 A * 2/1997 Unno et al. ..... 430/126
5,998,080 A * 12/1999 Ohno et al. ..... 430/124
6,132,919 A * 10/2000 Ogawa et al. ..... 430/110.2

FOREIGN PATENT DOCUMENTS

| | | | |
|---|---|---|---|
| EP | 952495 A1 | * | 10/1999 |
| JP | 63-173067 | | 7/1988 |
| JP | 03-203746 | | 9/1991 |
| JP | 04-184348 | | 7/1992 |
| JP | 05-197193 | | 8/1993 |
| JP | 06-161144 | | 6/1994 |
| JP | 08-314186 | | 11/1996 |
| WO | WO98/20396 | * | 5/1998 |

* cited by examiner

*Primary Examiner*—Janis L. Dote
(74) *Attorney, Agent, or Firm*—Armstrong, Kratz, Quintos, Hanson & Brooks, LLP

(57) ABSTRACT

A toner for development of electrostatic images, comprising colored particles containing at least a binder resin, a colorant and a softening agent, wherein the softening agent is an organic compound having a molecular weight of at least 1,000, a solubility of at least 5 g in 100 g of styrene as measured at 25° C., and an acid value of at most 10 mg KOH/g. The toner is excellent in fixing ability, shelf stability and flowability and permits forming images having high image quality. A production process thereof is also provided.

14 Claims, No Drawings

TONER FOR DEVELOPING STATIC CHARGE IMAGE AND METHOD FOR PREPARATION THEREOF

TECHNICAL FIELD

The present invention relates to a toner for development of electrostatic images for developing electrostatic latent images formed on a photosensitive body by an electrophotographic process, electrostatic recording process or the like and a production process thereof, and more particularly to a toner for development of electrostatic images, which is excellent in fixing ability, shelf stability and flowability and capable of forming high-quality images, and a production process thereof.

BACKGROUND ART

In an image forming apparatus such as an electrophotographic apparatus or electrostatic recording apparatus, exposure to a light pattern is conducted on a photosensitive member uniformly and evenly charged to form an electrostatic latent image (electrostatic image), and a developer is applied to the exposed region or unexposed region on the photosensitive member to conduct development. The developer image formed on the photosensitive member is generally transferred to a transfer medium such as paper or OHP sheet, and then fixed to the transfer medium by a method such as heating, pressing or use of solvent vapor.

As the developer, is used a toner for development of electrostatic images composed of colored particles comprising a binder resin in which a colorant and other additives (for example, a charge control agent, a parting agent, etc.) have been dispersed.

As toners for development of electrostatic images, ground toners obtained by melting and mixing a colorant and other additives in a thermoplastic resin to prepare a resin composition and then grinding and classifying the resin composition have heretofore been used mainly. In recent years, polymerized toners which are easy to control their particle diameter and permit omitting complicated steps such as grinding and classification and providing high-quality images have come to be widely used.

In general, a polymerized toner is produced by pouring a polymerizable monomer composition containing a polymerizable monomer, a colorant, a charge control agent, a parting agent and the like in an aqueous dispersion medium containing a dispersion stabilizer to disperse it in the aqueous medium by means of a mixer having high shearing force, thereby forming fine droplets of the monomer composition, and then subjecting the dispersion containing the fine droplets to suspension polymerization with a polymerization initiator. A polymer formed by the polymerization of the polymerizable monomer becomes a binder resin, and the colorant and other additives are dispersed therein.

The toner for development of electrostatic images has been required to permit forming a high-definition and high-density image having excellent image quality, undergo no deterioration of image quality even by changes in environments such as temperature and humidity and make it possible to conduct continuous printing or copying. In addition to these requirements, the toner for development of electrostatic images has been recently required to permit contributing to energy saving and coping with the speeding-up of printing or copying and the formation of full-color images. Therefore, the toner for development of electrostatic images has been required to improve its fixing properties such as lowering of fixing temperature without impairing the shelf stability (blocking resistance) while retaining the achievement of high image quality.

Specifically, in image forming apparatus such as copying machines, printers and the like of the electrophotographic system, in which the toner for development of electrostatic images is used, it has been recently attempted to reduce demand power. A step in which energy is particularly consumed in the electrophotographic system is a fixing step for fixing a developer image (toner image) after transferring the developer image on a photosensitive member to a transfer medium such as paper. In the fixing step, a fixing roll or fixing belt heated to a high temperature of at least 150° C. is used to fix the toner image to the transfer medium, and electricity is used as an energy source therefor. There is a demand for lowering this fixing temperature from the viewpoint of energy saving.

There has recently been a demand for the speeding-up of copying and printing. In particular, the speeding-up of copying and printing has been more and more required with the advancement of the combination of image forming apparatus and the formation of personal computer network. Therefore, it is necessary to shorten the fixing time in a high-speed printer or copying machine.

As a method for meeting such requirements from the image forming apparatus in the design of a toner for development of electrostatic images, there is a method in which a glass transition temperature of a binder resin is lowered. When the glass transition temperature of the binder resin is lowed, however, the resulting toner becomes poor in the so-called shelf stability because particles of the toner undergo blocking during storage of the toner or in a toner box of an image forming apparatus, to aggregate.

More recently, color-printing and color-copying techniques have been developed. In order to conduct color printing or color copying, an electrostatic latent image on a photosensitive member is developed with color toners of 3 or 4 different colors to transfer the resulting toner image to a transfer medium at a time or successively, and the toner image is then fixed. Therefore, the thickness of the toner layer to be fixed becomes thicker compared with a black-and-white image. In order to develop a desired color tone by color mixing, the respective color toners overlapped are required to be uniformly melted upon fixing of such color toners.

Therefore, the melt viscosity of each toner at about the fixing temperature thereof must be designed low compared with the conventional toners so as to become easy to melt. Means for lowering the melt viscosity of the toner include, for example, methods in which the molecular weight of a binder resin used is made lower compared with the resins for the conventional toners, and in which the glass transition temperature thereof is lowered. In any of these methods, however, the toner becomes poor in shelf stability because the toner tends to undergo blocking.

As described above, when the methods for improving a toner so as to cope with the energy saving, the speeding-up of printing and copying and the formation of color images are adopted, the shelf stability of the toner is deteriorated. More specifically, there is an adverse correlation between these methods and the shelf stability.

In order to provide a toner for development of electrostatic images having good low-temperature fixing ability, there has heretofore been proposed a method in which a low-softening point substance having parting property, such as paraffin wax, is caused to exist in a toner to lower the softening point of the toner (Japanese Patent Application Laid-Open Nos. 173067/1988 and 161144/1994). However, such a toner is difficult to achieve high image quality and balance the low-temperature fixing ability with the shelf stability at a high level.

Specifically, Japanese Patent Application Laid-Open No. 173067/1988 has proposed a production process of a polymerized toner, comprising the steps of adding polyolefin wax into a monomer mixture containing a polymerized monomer and a colorant, heating the resultant mixture to a temperature higher than a polymerization temperature to dissolve the polyolefin wax in the polymerizable monomer and then cooling the mixture down to a temperature equal to the polymerization temperature to deposit the polyolefin wax. According to this production process, however, the polyolefin wax is dissolved in the polymerizable monomer at the high temperature, and a polymerization initiator is then poured therein at the polymerization temperature, so that the control of the polymerization reaction is difficult to fail to easily obtain a uniform toner.

Japanese Patent Application Laid-Open No. 161144/1994 has proposed a toner in which a small amount of paraffin wax having no compatibility with a binder resin is contained in the resin. However, this toner is limited to the ground toner produced by mixing and kneading a binder resin, a colorant, wax and other additives with one another. and grinding and classifying the kneaded product. In addition, such a toner cannot be expected to have sufficient low-temperature fixing ability.

Japanese Patent Application Laid-Open No. 197193/1993 has proposed a polymerized toner of a phase-separation structure that toner particles comprise a high-softening resin (A) and a low-softening point substance (B), an A phase composed mainly of the high-softening resin is present in the vicinity of the surface of each particle, and a B phase composed mainly of the low-softening point substance is not present in the vicinity of the surface.

However, this toner of the phase-separation structure is good in blocking resistance, but yet high in fixing temperature and insufficient in low-temperature fixing ability. It is also difficult to contain a great amount of the low-softening point substance such as insoluble wax in a polymerizable monomer. In addition, when the low-softening point substance is contained in an adding amount shown in Examples of this publication in the toner, such a toner becomes too glossy and is difficult to achieve good image quality.

DISCLOSURE OF THE INVENTION

It is an object of the present invention to provide a toner for development of electrostatic images, which has a low fixing temperature, can meet energy saving, the speeding-up of printing and copying, the formation of full-color images, and the like, has excellent shelf stability and flowability and permits forming images high in resolution and good in image quality.

The present inventors have carried out an extensive investigation with a view toward achieving the above object. As a result, it has been found that the object can be achieved by containing an organic compound having a molecular weight of at-least 1,000, a solubility of at least 5 g in 100 g of styrene as measured at 25° C. and an acid value of at most 10 mg KOH/g as a softening agent in a toner for development of electrostatic images, which comprises at least a binder resin, a colorant and the softening agent and optionally contains various kinds of additives.

Since this specific organic compound has a good solubility at normal temperature in a polymerizable monomer, it is easy to be applied to a polymerized toner. This organic compound is preferably a low-softening point substance, particularly preferably a polyfunctional ester compound having a functionality of at least 5. Such an organic compound acts as a modifier such as a softening agent, a parting agent or an anti-offset agent on a toner. The present invention has been led to completion on the basis of these findings.

According to the present invention, there is thus provided a toner for development of electrostatic images, comprising colored particles containing at least a binder resin, a colorant and a softening agent, wherein the softening agent is an organic compound having:

(A) a molecular weight of at least 1,000, (B) a solubility of at least 5 g in 100 g of styrene as measured at 25° C., and (C) an acid value of at most 10 mg KOH/g.

According to the present invention, there is also provided a process for producing a toner for development of electrostatic images, comprising the step of subjecting a polymerizable monomer composition containing at least a polymerizable monomer, a colorant and a softening agent to suspension polymerization in an aqueous dispersion medium containing a dispersion stabilizer, said process comprising. using, as the softening agent, an organic compound having:

(A) a molecular weight of at least 1,000, (B) a solubility of at least 5 g in 100 g of styrene as measured at 25° C., and (C) an acid value of at most 10 mg KOH/g.

BEST MODE FOR CARRYING OUT THE INVENTION

1. Softening Agent:

In the present invention, an organic compound having a molecular weight of at least 1,000, a solubility of at least 5 g in 100 g of styrene as measured at 25° C. and an acid value of at most 10 mg KOH/g is used as a softening agent.

The molecular weight of the organic compound used as the softening agent is preferably 1,000 to 1,800, more preferably 1,100 to 1,800, particularly preferably 1,200 to 1,700. If the molecular weight of the softening agent is too low, it is difficult to sufficiently lower the fixing temperature of the resulting toner, and the offset resistance thereof also becomes insufficient. If the molecular weight of the softening agent is too low, such a softening agent becomes liable to bleed out of the resulting toner during storage of the toner or under high-temperature environment in a toner box, and the toner tends to cause a toner filming phenomenon on the surface of a photosensitive member, or the like in a durability test. When the molecular weight of the softening agent falls within the above range, balance among shelf stability, flowability, low-temperature fixing ability and the like of the resulting toner becomes good.

The solubility of the organic compound used as the softening agent in styrene must be at least 5 g in terms of a solubility in 100 g of styrene as measured at 25° C. (g/100 g of ST; 25° C.). This solubility is preferably 5 to 25 g, more preferably 8 to 25 g, particularly preferably 10 to 20 g. If the solubility of the softening agent in styrene is too low, the solubility of a polymerizable monomer composed mainly of styrene is generally lowered. Therefore, the content of the softening agent in the resulting toner becomes insufficient, resulting in difficulty in sufficiently lowering the fixing temperature of the toner. In addition, if the solubility is too low, it is necessary to heat the softening agent to a high temperature for dissolving a sufficient amount of the softening agent in the polymerizable monomer. Even if a softening agent poor in the solubility in styrene is dissolved in the polymerizable monomer at a high temperature, the softening agent is liable to be unevenly dispersed in the resulting polymerized toner.

The acid value of the organic compound used as the softening agent must be at most 10 mg KOH/g. The acid value of the softening agent is preferably 0.01 to 10 mg KOH/g, more preferably 0.01 to 8 mg KOH/g, particularly preferably 0.05 to 5 mg KOH/g. If the acid value of the softening agent is too high, an adverse influence is exerted on the formation of droplets of a polymerizable monomer composition in an aqueous dispersion medium, resulting in difficulty in stably forming droplets even in droplet diameter distribution. Any toner containing a softening agent high in acid value becomes unstable in charging property under high-temperature and high-humidity environment, resulting in difficulty in achieving sufficient image density. When the acid value falls within the above range, a toner sharp in particle diameter distribution and good in charging property can be provided.

The organic compound used in the present invention and having such properties as described above can be considered to function as a softening agent. However, it is desirable that the organic compound also has functions as a parting agent and an anti-offset agent in addition to such a function.

Such a softening agent is preferably a low-softening point substance exhibiting a maximum endothermic peak temperature in a range of 50 to 80° C. upon heating thereof in a DSC curve determined by a differential scanning calorimeter. Such a low-softening point substance can greatly contribute to the low-temperature fixing ability of the resulting toner. The maximum endothermic peak temperature of the softening agent is 55 to 70° C.

As such a softening agent as described above, is particularly preferred a polyfunctional ester compound having a functionality of at least 5. As examples of such a polyfunctional ester compound, may be mentioned condensates of a polyhydric alcohol having a functionality of at least 5 and a carboxylic acid. As the polyhydric alcohol, is particularly preferred dipentaerythritol. As the carboxylic acid, is preferred a long-chain carboxylic acid having 10 to 30 carbon atoms. The number of carbon atoms in the long-chain carboxylic acid is preferably 13 to 25. As examples of such a long-chain carboxylic acid, may be mentioned myristic acid, palmitic acid and lauric acid.

In the polyfunctional ester compound used in the present invention, one or more carboxylic acids may be condensed with the polyhydric alcohol having a functionality of at least 5. When at least two carboxylic acids are used in combination, they are desirably selected in such a manner that a difference between the maximum value and the minimum value of the number of carbon atoms in said at least two carboxylic acids is at most 9, preferably at most 5. Further, the polyfunctional ester compound is preferably a completely esterified compound, and not a partially esterified compound.

Specific examples of the polyfunctional ester compound preferably used as the softening agent in the present invention include dipentaerythritol hexamyristate, dipentaerythritol hexapalmitate and dipentaerythritol hexalaurate. These polyfunctional ester compounds may be used either singly or in any combination thereof.

A proportion of the softening agent used is generally 0.1 to 40 parts by weight, preferably 1 to 30 parts by weight, more preferably 5 to 20 parts by weight per 100 parts by weight of the binder resin of the toner or the polymerizable monomer forming the binder resin. If the proportion of the softening agent such as the polyfunctional ester compound used is too low, it is difficult to provide a toner excellent in low-temperature fixing ability. If the proportion of the softening agent used is too high, the offset resistance of the resulting toner is deteriorated, and the toner filming on the surface of a photosensitive member tends to occur. In many cases, particularly good results can be yielded when the proportion of the softening agent used is about 8 to 15 parts by weight.

Toner for Development of Electrostatic Images:

The toner for development of electrostatic images according to the present invention is not particularly limited by a production process thereof so far as it is composed of colored particles containing at least a binder resin, a colorant and a specific softening agent. Examples of the binder resin component include (co) polymers of a vinyl compound, such as styrene-acrylic ester copolymers, polyester resins and alicyclic polyolefin resins.

The toner for development of electrostatic images can be obtained by, for example, the grinding process or the polymerization process. Examples of the polymerization process include an emulsion polymerization process, an aggregation process, a dispersion polymerization and a suspension polymerization. According to the polymerization process, toner particles of micron order can be directly obtained in a relatively narrow particle diameter distribution. The toner according to the present invention may also be a toner having a core-shell structure (capsule toner) that a resin coating layer is formed on each surface of the colored particles.

The toner according to the present invention is particularly preferably a polymerized toner obtained by suspension polymerization from the viewpoint of developer properties. The toner of the core-shell structure is preferably obtained by a process comprising forming colored particles using as core particles, polymerizing a polymerizable monomer for shell in the presence of the colored particles to form core-shell type polymer particles in which the colored particles are covered with a polymer layer formed by the polymerizable monomer for shell.

The volume average particle diameter (dv) of the toner for development of electrostatic images (including the toner of the core-shell structure) according to the present invention is generally 2 to 10 $\mu$m, preferably 2 to 9 $\mu$m, more preferably 3 to 8 $\mu$m, and the particle diameter distribution (dv/dp) represented by a ratio of the volume average particle diameter (dv) to the number average particle diameter (dp) is generally at most 1.6, preferably at most 1.5, more preferably at most 1.3.

The average thickness of the shell in the toner having the core-shell structure is generally 0.001 to 1.0 $\mu$m, preferably 0.003 to 0.5 $\mu$m, more preferably 0.005 to 0.2 $\mu$m. If the thickness of the shell is too great, the fixing ability of the toner tends to be deteriorated. If the thickness is too small, the effect of improving shelf stability of the toner becomes little.

Production Process of Toner for Development of Electrostatic Image:

A polymerized toner by suspension polymerization may be obtained by subjecting a polymerizable monomer composition containing at least a polymerizable monomer, a colorant and a softening agent to suspension polymerization in an aqueous dispersion medium containing a dispersion stabilizer. A polymer formed by the polymerization of the polymerizable monomer will become a binder resin. A polymerized toner having the core-shell structure may be produced in accordance with a spray drying process, interface reaction process, in situ polymerization process, phase separation process or the like. The in situ polymerization process and phase separation process are particularly preferred in that production efficiency is good.

Specifically, the polymerized toner having the core-shell structure can be obtained by using, as core, colored polymer particles obtained by the polymerizable monomer composition containing at least the polymerizable monomer, the colorant and the softening agent to suspension polymerization in the aqueous dispersion medium containing the dispersion stabilizer, and subjecting a polymerizable monomer for shell to suspension polymerization in the presence of the core. A polymer layer formed by polymerization of the polymerizable monomer for shell will become a resin coating layer. The polymerizable monomer composition may contain various kinds of additives such as a crosslinkable monomer, a macromonomer, a molecular weight modifier, a charge control agent, a general-purpose parting agent, a lubricant and dispersion aid as needed.

(1) Polymerizable Monomer:

As the polymerizable monomers used in the present invention, is preferred monovinyl monomers. Specific examples thereof include styrenic monomers such as styrene, vinyltoluene and α-methylstyrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone.

The monovinyl monomers may be used either singly or in any combination thereof. As the monovinyl monomers, a styrenic monomer and a derivatives of (meth)acrylic acid are preferably used in combination.

(2) Crosslinkable Monomer and Crosslinkable Polymer:

When a crosslinkable monomer and/or a crosslinkable polymer is used in addition to the polymerizable monomer, the hot offset resistance of the resulting toner can be effectively improved.

The crosslinkable monomer is a monomer having two or more polymerizable carbon-carbon unsaturated double bonds. Specific examples thereof include aromatic divinyl compounds such as divinylbenzene, divinylnaphthalene and derivatives thereof; di-ethylenically unsaturated carboxylic acid esters such as ethylene glycol dimethacrylate, diethylene glycol dimethacrylate and 1,4-butanediol diacrylate; other divinyl compounds such as N,N-divinylaniline and divinyl ether; and compounds having three or more vinyl groups, such as trimethylolpropane triacrylate and trimethylolpropane trimethacrylate.

The crosslinkable polymer is a polymer having two or more polymerizable carbon-carbon unsaturated double bonds. Specific examples thereof include esters of a polymer such as polyethylene or polypropylene, which has two or more hydroxyl groups in its molecule, with an unsaturated carboxylic acid such as acrylic acid or methacrylic acid.

These crosslinkable monomers and crosslinkable polymers may be used either singly or in any combination thereof. The crosslinkable monomer and/or the crosslinkable polymer is used in a proportion of generally at most 10 parts by weight, preferably 0.01 to 5 parts by weight, more preferably 0.05 to 2 parts by weight, particularly preferably 0.1 to 1 part by weight per 100 parts by weight of the polymerizable monomer.

(3) Macromonomer:

When a macromonomer is used together with the polymerizable monomer, a balance among the shelf stability, offset resistance and low-temperature fixing ability of the resulting polymerized toner can be improved. The macromonomer is a relatively long-chain linear molecule having a polymerizable functional group (for example, a unsaturated group such as a carbon-carbon double bond) at its molecular chain terminal. The macromonomer is preferably an oligomer or polymer having a number average molecular weight of generally 1,000 to 30,000. When a macromonomer having a low number average molecular weight is used, the surface portions of the resulting toner particles become soft, whereby the shelf stability of the toner is deteriorated. When a macromonomer having a high number average molecular weight is used on the other hand, the flexibility of such a macromonomer is poor, resulting in a toner deteriorated in fixing ability.

As specific examples of the macromonomer, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton (including macromonomers disclosed in Japanese Patent Application Laid-Open No. 203746/1991).

Among the macromonomers, polymers having a higher glass transition temperature than that of the binder resin are preferred, with copolymer macromonomers of styrene and a methacrylic ester and/or an acrylic ester, and poly (methacrylic ester) macromonomers being particularly preferred.

When the macromonomer is used, it is used in a proportion of generally 0.01 to 10 parts by weight, preferably 0.03 to 5 parts by weight, more preferably 0.05 to 1 part by weight per 100 parts by weight of the polymerizable monomer.

(4) Colorant:

As the colorant, may be used any of various kinds of pigments and dyes used in the field of toners, such as carbon black and titanium white. As examples of black colorants, may be mentioned dyes and pigments such as carbon black and Nigrosine Base; and magnetic powders such as cobalt, nickel, triuron tetroxide, manganese iron oxide, zinc iron oxide and nickel iron oxide. When carbon black is used, that having a primary particle diameter of 20 to 40 nm is preferably used in that the resulting toner can provide images good in image quality, and the safety of the toner in environment is enhanced.

As colorants for color toners, may be used yellow colorants, magenta colorants, cyan colorants, etc.

Examples of the yellow colorants include C.I. Pigment Yellow 3, 12, 13, 14, 15, 17, 62, 65, 73, 83, 90, 93, 97, 120, 138, 155, 180 and 181; Naphthol Yellow S, Hansa Yellow G, and C.I. Vat Yellow.

Examples of the magenta colorants include azo pigments, fused polycyclic pigments, etc., and specific examples thereof include C.I. Pigment Red 48, 57, 58, 60, 63, 64, 68, 81, 83, 87, 88, 89, 90, 112, 114, 122, 123, 144, 146, 149, 163, 170, 184, 185, 187, 202, 206, 207, 209 and 25; and C.I. Pigment Violet 19.

Examples of the cyan colorants include copper phthalocyanine compounds and derivatives thereof, and anthraquinone compounds, and specific examples thereof include C.I. Pigment Blue 2, 3, 6, 15, 15:1, 15:2, 15:3, 15:4, 16, 17and 60; Phthalocyanine Blue, C.I. Vat Blue 6, and C.I. Acid Blue.

The colorants are used in a proportion of generally 0.1 to 50 parts by weight, preferably 1 to 20 parts by weight per 100 parts by weight of the binder resin or the polymerizable monomer forming the binder resin.

(5) Molecular Weight Modifier:

As examples of the molecular weight modifier, may be mentioned mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.01 to 10 parts by weight, preferably 0.1 to 5 parts by weight per 100 parts by weight of the polymerizable monomer.

(6) Lubricant and Dispersion Aid:

A lubricant, such as a fatty acid such as oleic acid or stearic acid, or a fatty acid metal salt composed of a fatty acid and a metal such as Na, K, Ca, Mg or Zn; a dispersion aid such as a silane or titanium coupling agent; and/or the like may also be used with a view toward uniformly dispersing the colorant in the resulting toner particles. Such a lubricant or dispersion aid is generally used in a proportion of about 1/1,000 to 1/1 based on the weight of the colorant.

(7) Charge Control Agent:

In order to improve the charge properties of the resulting toner, various kinds of charge control agents having positively charging ability or negatively charging ability are preferably contained in the polymerizable monomer composition. Examples of the charge control agents include metal complexes of organic compounds having a carboxyl group or a nitrogen-containing group, metallized dyes, nigrosine and charge control resins.

More specifically, may be mentioned charge control agents such as BONTRON N-01 (product of Orient Chemical Industries Ltd.), Nigrosine Base EX (product of Orient Chemical Industries Ltd.), SPIRON Black TRH (product of Hodogaya Chemical Co., Ltd.), T-77 (product of Hod6gaya Chemical Co., Ltd.), BONTRON S-34 (product of Orient Chemical Industries Ltd-.), BONTRON E-81 (product of Orient Chemical Industries Ltd.), BONTRON E-84 (product of Orient Chemical Industries Ltd.), BONTRON E-89 (product of Orient Chemical Industries Ltd.), BONTRON F-21 (product of Orient Chemical Industries Ltd.), COPY CHRGE NX VP434 (product of Clariant Co.), COPY CHRGENEGVP2036 (product of Clariant Co.), TNS-4-1 (product of Hodogaya Chemical Co., Ltd.), TNS-4-2 (product of Hodogaya Chemical Co., Ltd.), LR-147 (product of The Japan Carlit Co., Ltd.) and COPY BLUE-PR (product of Hoechst AG); and charge control resins such as quaternary ammonium (salt) group-containing copolymers and sulfonic (salt) group-containing copolymers. The charge control agent is used in a proportion of generally 0.01 to 10 parts by weight, preferably 0.03 to 5 parts by weight per 100 parts by weight of the binder resin or the polymerizable monomer forming the binder resin.

(8) Parting Agent:

Since the polyfunctional ester compound used as the softening agent in the present invention also acts as a parting agent, the use of any other parting agent is unnecessary. However, various kinds of parting agents may be contained, as needed, for the purpose of, for example, preventing offset or improving the parting ability of the resulting toner upon fixing by a heated roll.

As examples of the parting agent, may be mentioned low molecular weight polyolefin waxes such as low molecular weight polyethylene, low molecular weight polypropylene and low molecular weight polybutylene; molecular terminal-modified polyolefin waxes such as molecule terminal-oxidized low molecular weight polypropylene, molecular terminal-modified low molecular weight polypropylene substituted by an epoxy group at its molecular terminal and block polymers of these compounds with low molecular weight polyethylene, and molecule terminal-oxidized low molecular weight polyethylene, molecular terminal-modified low molecular weight polyethylene substituted by an epoxy group at its molecular terminal and block polymers of these compounds with low molecular weight polypropylene; vegetable natural waxes such as candelilla wax, carnauba wax, rice wax, Japan wax, jojoba wax and sasol; petroleum waxes such as paraffin wax, microcrystalline wax and petrolatum, and modified waxes thereof; mineral waxes such as montan, ceresin and ozokerite; synthetic waxes such as Fischer-Tropsch wax; polyfunctional ester compounds such as pentaerythritol tetrastearate, pentaerythritol tetramyristate and pentaerythritol tetrapalmitate; and mixtures thereof.

These parting agents are used in a proportion of generally 0.1 to 20 parts by weight, preferably 0.5 to 15 parts by weight, more preferably 1 to 5 parts by weight per 100 parts by weight of the binder resin or the polymerizable monomer forming the binder resin.

(9) Polymerization Initiator:

As the polymerization initiator, is preferably used a radical polymerization initiator. As specific examples thereof, may be mentioned persulfates such as potassium persulfate and ammonium persulfate; azo compounds such as 4,4'-azobis(4-cyanovaleric acid), 2,2'-azobis (2-amidinopropane) dihydrochloride, 2,2'-azobis-2-methyl-N-1,1-bis (hydroxymethyl)-2-hydroxyethylpropionamide, 2,2'-azobis (2,4-dimethylvaleronitrile), 2,2'-azobis-isobutyronitrile and 1,1'-azobis (1-cyclohexane-carbonitrile); diacyl peroxides such as isobutyryl peroxide, 2,4-di-chlorobenzoyl peroxide and 3,5,5'-trimethylhexanoyl peroxide; peroxy dicarbonates such as bis(4-t-butylcyclohexyl)peroxy dicarbonate, di-n-propylperoxy dicarbonate, diisopropylperoxy dicarbonate, di-2-ethoxyethylperoxy dicarbonate, di(2-ethylethylperoxy) dicarbonate, dimethoxybutylperoxy dicarbonate and di(3-methyl-3-methoxybutylperoxy) dicarbonate; and other. peroxides such as ($\alpha$,$\alpha$-bis-neodecanoylperoxy)-diisopropylbenzene, cumylperoxy neodecanoate, 1,1', 3,3'-tetramethylbutylperoxy neodecanoate, 1-cyclohexyl-1-methylethylperoxy neodecanoate, t-hexylperoxy neodecanoate, t-butylperoxy neodecanoate, t-hexylperoxy pivalate, t-butylperoxy pivalate, methyl ethyl peroxide, di-t-butyl peroxide, acetyl peroxide, dicumyl peroxide, lauroyl peroxide, benzoyl peroxide, t-butylperoxy-2-ethyl hexanoate, di-isopropylperoxy dicarbonate, di-t-butylperoxy isophthalate and t-butylperoxy isobutyrate. Redox initiators composed of combinations of these polymerization initiators with a reducing agent may also be used.

Of these, oil-soluble.radical polymerization initiators soluble in the polymerizable monomer are preferred. A water-soluble initiator may also be used in combination therewith as needed. As the oil-soluble radical initiators, oil-soluble radical initiators selected from among organic peroxides whose decomposition temperature giving a half-life period of 10 hours are 40 to 80° C., preferably. 45 to 80° C. and whose molecular weights are 300 or lower are preferred, with t-butyl peroxy-2-ethylhexanoate and t-butyl peroxyneodecanoate being particularly preferred because the resulting polymerized toner barely causes environmental destruction by volatile components such as odor.

The proportion of the polymerization initiator used is generally 0.1 to 20 parts by weight, preferably 0.3 to 15 parts by weight, more preferably 0.5 to 10 parts by weight per 100 parts by weight of the polymerizable monomer. If this proportion is too low, the rate of polymerization becomes slow. If the proportion is too high, the molecular weight of the resulting polymer becomes low. It is hence not preferred to use the polymerization initiator in such a too low or high proportion. Although the polymerization initiator may be added into the polymerizable monomer composition in advance, it may also be added into the suspension after completion of the step of forming droplets of the polymerizable monomer composition in the aqueous dispersion medium for the purpose of, for example, avoiding premature polymerization.

The proportion of the polymerization initiator used is generally 0.001 to 3% by weight based on the aqueous dispersion medium. If the proportion of the polymerization initiator used is lower than 0.001% by weight, the rate of polymerization becomes slow. If the proportion is higher than 3% by weight, the molecular weight of the resulting polymer becomes low. It is hence not preferred to use the polymerization initiator in such a too low or high proportion.

(10) Dispersion Stabilizer:

As examples of the dispersion stabilizer used in the present invention, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; metal hydroxides such as aluminum hydroxide, magnesium hydroxide and ferric hydroxide; water-soluble polymers such as polyvinyl alcohol, methyl cellulose and gelatin; and surfactants such as anionic surfactants, nonionic surfactants and amphoteric surfactants.

Among these, metallic compounds such as the sulfates, carbonates, metal oxides and metal hydroxides are preferred, with colloid of hardly water-soluble metallic compounds being more preferred. In particular, colloid of hardly water-soluble metal hydroxides is preferred because the particle diameter distribution of the resulting toner particles can be narrowed, and the brightness or sharpness of an image formed from such a toner is enhanced.

The colloid of the hardly water-soluble metal hydroxide is not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase. The colloid of the hardly water-soluble metal hydroxide preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m. If the particle diameter of the colloid is too great, the stability of the polymerization reaction system is broken, and the shelf stability of the resulting toner is deteriorated.

The dispersion stabilizer is used in a proportion of generally 0.1 to 20 parts by weight, preferably 0.3 to 10 parts by weight per 100 parts by weight of the polymerizable monomer. If this proportion of the dispersion stabilizer used is too low, it is difficult to achieve sufficient polymerization stability, so that polymer aggregates are liable to form. If the proportion of the dispersion stabilizer used is too high on the other hand, the particle diameter distribution of the resulting toner particles is widened due to increase in fine particles, and the viscosity of the aqueous solution is increased, so that polymerization stability is lowered.

(11) Production Process of Colored Particles:

A polymerized toner can be provided as colored particles composed of a polymer containing a colorant and the like by subjecting a polymerizable monomer composition containing at least a polymerizable monomer, the colorant and a specific softening agent to suspension polymerization in an aqueous medium containing a dispersion stabilizer.

More specifically, the polymerizable monomer, colorant, softening agent and other additives (a charge control agent, parting agent, etc.) are mixed, and the resultant mixture is uniformly dispersed by means of a bead mill or the like to prepare a polymerizable monomer composition which is an oily liquid mixture. The polymerizable monomer composition is then poured into the aqueous medium containing the dispersion stabilizer, and the resultant suspension is stirred by a stirrer. After the droplet diameter of droplets of the polymerizable monomer composition becomes uniform, the polymerization initiator is poured to cause it to migrate into the droplets of the polymerizable monomer composition.

The droplets of the polymerizable monomer composition are then made finer by means of a mixing device having high shearing force. In this droplet-forming step, droplets having a droplet diameter of generally 2 to 10 $\mu$m, preferably 2 to 9 $\mu$m, more preferably 3 to 8 $\mu$m are formed in the aqueous dispersion medium. If the droplet diameter of the droplets is too great, toner particles formed become too great, so that the resolution of an image formed with such a toner is deteriorated. A ratio of the volume average droplet diameter to the number average droplet diameter of the droplets is generally 1 to 3, preferably 1 to 2. If the droplet diameter distribution of the droplets is too broad, the fixing temperature of the resulting toner varies, so that inconveniences such as fogging and filming tend to occur. The droplets preferably have a droplet diameter distribution that at least 30 vol. %, preferably at least 60 vol. % of the droplets are present within a range of (the volume average droplet diameter ±1 $\mu$m).

After droplets having a droplet diameter almost equal to the particle diameter of a polymerized toner to be formed are formed in the above-described manner, polymerization is conducted at a temperature of generally 5 to 120° C., preferably 35 to 95° C. In the present invention, it is preferred that the aqueous dispersion medium containing the droplets of the polymerizable monomer composition be prepared in a separate container or a mixing device, and this dispersion be then charged into a polymerization reactor to conduct the polymerization. When the droplets are formed in the polymerization reactor, and the suspension polymerization is conducted as it is, scale is formed in the reactor to easily form a great amount of coarse particles.

Colored polymer particles are formed in such a manner. The colored particles formed are recovered and then used as a polymerized toner.

(12) Production Process of Core-shell Type Polymer Particles:

A capsule toner having a core-shell structure may be generally produced in accordance with a spray drying process, interface reaction process, in situ polymerization process, phase separation process or the like.

In the in situ polymerization process preferably adopted in the present invention, the colored particles obtained by subjecting the polymerizable monomer composition containing at least the polymerizable monomer, the colorant and the specific softening agent to suspension polymerization are used as core, and a polymerizable monomer for shell is subjected to suspension polymerization in the presence of the core, thereby forming core-shell type polymer particles.

When a water-soluble polymerization initiator is added upon the addition of the polymerizable monomer for shell to the polymerization reaction system, the polymer particles having the core-shell structure are easy to be formed.

As polymerizable monomers for core used in the present invention, the same polymerizable monomers as described above may be exemplified. Among those, a monomer capable of forming a polymer having a glass transition temperature of generally at most 60° C., preferably about 40 to 60° C. are preferred as the monomers for core. If the glass transition temperature of the polymer component forming the core is too high, the fixing temperature of the resulting toner becomes high. If the glass transition temperature is too low on the other hand, the shelf stability of the toner is deteriorated. In order to adjust the glass transition temperature, 2 or more monomers are often used in combination as the monomers for core.

In the present invention, the glass transition temperature (Tg) of a polymer is a calculated value (referred to as calculated Tg) calculated out according to the kinds and proportions of monomers used in accordance with the following equation:

$$100/Tg=W_1/T_1+W_2/T_2+W_3/T_3+\ldots W_n/T_n$$

wherein

Tg: the glass transition temperature of the copolymer (absolute temperature), $W_1$, $W_2$, $W_3$ . . . $W_n$: % by weight of the monomers forming the copolymer composition, $T_1$, $T_2$, $T_3$ . . . $T_n$: glass transition temperature (absolute temperature) of a homopolymer formed from each of the monomers forming the copolymer composition.

n: the number of the monomers.

The numbers attached to W and T indicate that such numerical values are those as to the same monomer.

In the case where the toner according to the present invention is a capsule toner, the volume average particle diameter (dv) of the core particles is generally 2 to 10 μm, preferably 2 to 9 μm, more preferably 3 to 8 μm. The ratio of the volume average particle diameter (dv) to the number average particle diameter (dp) of the core particles is generally at most 1.7, preferably at most 1.5, more preferably at most 1.3. The core particles having such particle diameter and particle diameter distribution can be obtained by the above-described suspension polymerization.

A monomer for shell is added to the core particles thus obtained to conduct polymerization again, whereby a shell layer of the capsule toner can be formed.

As examples of a specific process for forming the shell, may be mentioned a process in which the polymerizable monomer for shell is added to the reaction system of the polymerization reaction which has been conducted for obtaining the core particles, thereby continuously conducting polymerization, and a process in which the core particles obtained in a separate reaction system are charged, to which the polymerizable monomer for shell is added, thereby conducting polymerization stepwise.

The polymerizable monomer for shell may be added to the reaction system in one lot, or continuously or intermittently by means of a pump such as a plunger pump.

The monomer for shell is that capable of forming a polymer having a higher glass transition temperature than that of the polymer forming the core particles. As polymerizable monomers for forming the shell, polymerizable monomers capable of forming a polymer having a glass transition temperature exceeding 80° C., such as styrene and methyl methacrylate, may be used either singly or in any combination. Herein, the glass transition temperature is a value calculated out in the same manner as described above.

When the glass transition temperature of a polymer composed of the polymerizable monomer for the shell is preset so as to become than that of the polymer composed of the polymerizable monomer for the core particles, whereby the fixing temperature of a toner formed can be lowered to enhance the shelf stability of the toner. The glass transition temperature of the polymer formed from the polymerizable monomer for shell is generally higher than 50° C., but not higher than 120° C., preferably higher than 60° C., but not higher than 110° C., more preferably higher than 80° C., but not higher than 105° C. in order to improve the shelf stability of the polymerized toner.

A difference in glass transition temperature between the polymer formed from the polymerizable monomer for core and the polymer formed from the polymerizable monomer for shell is generally at least 10° C., preferably at least 20° C., more preferably at least 30° C.

It is preferable to add a water-soluble radical initiator at the time the polymerizable monomer for shell is added from the viewpoint of easy provision of a capsule toner. It is considered that when the water-soluble radical initiator is added, the water-soluble initiator enters in the vicinity of each surface of the core particles to which the polymerizable monomer for shell has migrated, so that the polymer layer is easy to be formed on the core particle surface.

As examples of the water-soluble polymerization initiators, may be mentioned persulfates such as potassium persulfate and ammonium persulfate; azo type initiators such as 4,4'-azobis(4-cyanovaleric acid), 2,2'-azobis (2-amidinopropane) bihydrochloride and 2,2'-azobis-2-methyl-N-1,1'-bis (hydroxymethyl)-2-hydroxyethylpropionamide; and combinations of an oil-soluble initiator such as cumene peroxide and a redox catalyst. The amount of the water-soluble polymerization initiator is generally 0.001 to 3% by weight based on the aqueous dispersion medium.

A proportion of the polymerizable monomer for core to the polymerizable monomer for shell to be used is generally 80:20 to 99.9:0.1 in terms of a weight ratio. If the proportion of the polymerizable monomer for shell is too low, the effect of improving the shelf stability becomes little. If the proportion is too high on the other hand, the improving effect to lower the fixing temperature of the resulting polymerized toner becomes little. The thickness of the shell is generally 0.001 to 1.0 μm, preferably 0.003 to 0.5 μm, more preferably 0.005 to 0.2 μm.

(13) Non-magnetic One-component Developer:

When the toner according to the present invention is used as a non-magnetic one-component developer, external additives may be mixed as needed. As the external additives, may be mentioned inorganic particles and organic resin particles which act as a flowability-imparting agent and an abrasive.

Examples of the inorganic particles include particles of silicon dioxide (silica), aluminum oxide (alumina), titanium oxide, zinc oxide, tin oxide, barium titanate, strontium titanate, etc. Examples of the organic resin particles include particles of methacrylic ester polymers, acrylic ester polymers, styrene-methacrylic ester copolymers and styrene-acrylic ester copolymers, and core-shell type particles in which the core is composed of a methacrylic ester polymer, and the shell is composed of a styrene polymer.

Among these, the particles of the inorganic oxides are preferred, with silicon dioxide particles being particularly preferred. The surfaces of the inorganic fine particles may be subjected to a hydrophobicity-imparting treatment. Silicon dioxide particles subjected to the hydrophobicity-imparting treatment are particularly preferred. Two or more of the external additives may be used in combination. When the external additives are used in combination, it is preferable to use two kinds of inorganic particles different in average particle diameter from each other or inorganic particles and organic resin particles in combination. No particular limitation is imposed on the amount of the external additives added. However, it is generally 0.1 to 6 parts by weight per 100 parts by weight of the toner particles. The adhesion of the external additives to the toner particles is generally conducted by charging the toner and external additives into a mixer such as a Henschel mixer to mix them under stirring.

EXAMPLES

The present invention will hereinafter be described more specifically by the following Examples and Comparative Examples. All designations of "part" or "parts" and "%" as will be used in the following examples mean part or parts by weight and % by weight unless expressly noted. Physical properties and properties in the following Examples and Comparative Examples were evaluated in accordance with the following respective methods.

(1) Solubility in Styrene (g/100 g ST; 25° C.)

The solubility of a softening agent such as a polyfunctional ester compound was determined in terms of an amount (g/100 g ST) of the softening agent dissolved in 100 g of styrene at 25° C.

(2) Acid Value (mg KOH/g):

Measured in accordance with JIS K 1557 (1970). About 50 g of a sample was precisely weighed in a 300-ml beaker, and 128 ml of acetone (80 v/v%) were added to this sample. After the sample was dissolved therein, this solution was subjected to potentiometric titration with a 0.1N aqueous solution of NaOH by means of a pH meter to regard a point of inflection on a titration curve thus obtained as an end point.

The acid value was found in accordance with the following equation:

$$A=[5.61\times(B-C)\times f]/S$$

Wherein

A: an acid value (KOH mg/g);

B: an amount (ml) of the 0.1N aqueous solution of sodium hydroxide used in the titration of the sample;

C: an amount (ml) of the 0.1N aqueous solution of sodium hydroxide used in a blank test;

f: a factor of the 0.1N aqueous solution of sodium hydroxide; and

S: an amount (g) of the sample used.

(3) Maximum Endothermic Peak Temperature (° C.):

The maximum endothermic peak temperature of a softening agent sample such as a polyfunctional ester compound was measured in accordance with ASTM D 3418-82. More specifically, a differential scanning calorimeter was used to heat the sample at a heating rate of 10° C./min, thereby measuring a temperature exhibiting a maximum endothermic peak on a DSC curve obtained in the course thereof. When the endothermic peak is broad, a peak top thereof was judged to be an endothermic peak temperature. As the differential scanning calorimeter, "SSC5200" manufactured by Seiko Instruments Inc. was used. With respect to each toner sample, a maximum endothermic peak temperature attributable to the softening agent was measured similarly.

(4) Droplet Diameter (μm) of Polymerizable Monomer Composition:

The volume average droplet diameter (dv), and droplet diameter distribution, i.e., a ratio (dv/dp) of the volume average droplet diameter (dv) to the number average droplet diameter (dp) of droplets were measured by means of a particle diameter distribution meter (SALD 2000A Model, manufactured by Shimadzu Corporation). In the measurement by the particle diameter distribution meter, the measurement was conducted under conditions of a refractive index of 1.55–0.20i, and irradiation time of ultrasonic wave of 5 minutes.

(5) Particle Diameter (μm) of Toner:

The volume average particle diameter (dv), and particle diameter distribution, i.e., a ratio (dv/dp) of the volume average particle diameter (dv) to the number average particle diameter (dp) of polymer particles were measured by means of a Multisizer (manufactured by Coulter Co.). The measurement by the Multisizer was conducted under the following conditions:

aperture diameter: 100 μm;

medium: Isotone, concentration: 10%; and number of particles measured: 50,000 particles.

(6) Thickness of Shell:

Since the thickness of a shell was thin, the thickness of a shell in each toner sample was calculated out in the following equation:

$$x=r(1+S/100\rho)^{1/3}r$$

wherein r: the radius of core particles before addition of a monomer for shell (a half of the volume average particle diameter of the core particles found from measurement by the Multisizer; μm);

x: the thickness (μm) of shell;

s: the number of parts of the monomer for shell added per 100 parts by weight of a monomer for core ρ:the density (g/cm$^3$) of a polymer forming the shell.

In this measurement, ρ is regarded as 1.0 g/cm$^3$ to calculate out the value of x.

(7) Volume Resistivity of Toner:

The volume resistivity of-each toner sample was measured by means of a dielectric loss measuring device (TRS-10 Model, trade name; manufactured by Ando Electric Co., Ltd.) under conditions of a temperature of 30° C. and a frequency of 1 kHz.

(8) Fixing Temperature of Toner:

A commercially available printer (at a rate of 20 paper sheets per minute) of the non-magnetic one-component development system was modified in such a manner that the temperature of a fixing roll can be varied. This modified printer was used to conduct a fixing test. The fixing test was carried out by varying the temperature of the fixing roll in the modified printer to determine the fixing rate at each temperature, thereby finding a relationship between the temperature and the fixing rate.

The fixing rate was calculated from a ratio of image densities before and after a peeling operation using an pressure-sensitive adhesive tape, which was conducted against a black solid-printed area of a test paper sheet, on which printing had been made by the modified printer. More specifically, assuming that the image density before the peeling of the adhesive tape is "$ID_{before}$", and the image density after the peeling of the adhesive tape is "$ID_{after}$", the fixing rate can be calculated out from the following equation:

$$\text{Fixing/rate } (\%)=(ID_{after}/ID_{before})\times 100$$

The peeling operation of the adhesive tape is a series of operation that a pressure-sensitive adhesive tape (SCOTCH Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

In this fixing test, a temperature of the fixing roll at which a fixing rate of the toner amounted to 80% was defined as a fixing temperature of the toner.

(9) Flowability:

Three kinds of sieves having sieve openings of 150 μm, 75 μm and 45 μm, respectively, are laid on top of another in that order from above, and a toner sample (4 g) to be measured was precisely weighed and put on the uppermost sieve. The three kinds of sieves are then vibrated for 15 seconds by means of a powder measuring device ("REOSTAT", trade name; manufactured by Hosokawa Micron Corporation) under conditions of vibration intensity of 4. Thereafter, the weight of the toner captured on each sieve was measured and substituted into its corresponding equation $\hat{1}$, $\hat{2}$ or $\hat{3}$ shown below, thereby finding the values of a, b and c. These values were substituted into the equation $\hat{4}$ to calculate out the value of flowability. The measurement was conducted 3 times on one sample to find an average value thereof.

$\hat{1}$ a=[(weight (g) of the toner remaining on the sieve of 150 μm)/4 g]×100

$\hat{2}$ b=[(weight (g) of the toner remaining on the sieve of 75 μpm/)4 g]×100×0.6

$\hat{3}$ c=[(weight (g) of the toner remaining on the sieve of 45 μm) /4 g]×100×0.2

$\hat{4}$ Flowability (%)=100−(a+b+c).

(10) Shelf Stability:

Each developer sample was placed in a closed container to seal it, and the container was then sunk into a constant-temperature water bath controlled to 50° C. The container was taken out of the constant-temperature water bath after 24 hours had elapsed, and the developer contained in the container was transferred to a 42-mesh sieve. At this time, the developer was quietly taken out of the container so as not to destroy the aggregate structure of the developer in the container, and carefully transferred to the sieve. The sieve was vibrated for 30 seconds by means of the above powder measuring device under conditions of vibration intensity of 4.5. The weight of the developer remaining on the sieve was then measured to regard it as the weight of the developer aggregated. A proportion ( % by weight) of the weight of the aggregated developer to the weight of the developer first put into the container was calculated out. The measurement was conducted 3 times on one sample to use the average value thereof as an index to the shelf stability.

(11) Evaluation of Image Quality:

The above-described modified printer was used to continuously conduct printing from the beginning under respective environments of a temperature of 35° C. and a relative humidity of 80% (35° C. ×80% RH; H/H environment) and a temperature of 10° C. and a relative humidity of 20% (10° C. ×20% RH; L/L environment)), thereby counting the number of printed sheets that continuously retained an image density of 1.3 or higher as measured by a reflection densitometer (manufactured by McBeth Co.) and at an unprinted area, fog of 15% or lower as determined by a whiteness meter (manufactured by Nippon Denshoku K.K.) to evaluate each developer sample as to environmental dependency.

(12) Durability:

Printing was continuously conducted from the beginning by means of the above-described modified printer under a room-temperature environment of 23° C. in temperature and 50% in RH to count the number of printed sheets that continuously retained an image density of 1.3 or higher as measured by a reflection densitometer (manufactured by McBeth Co.) and at an unprinted area, fog of 15% or lower as determined by a whiteness meter (manufactured by Nippon Denshoku K.K.), thereby evaluating each developer sample as to the durability of image quality.

Example 11

(1) Preparation of Polymerizable Monomer Composition:

After 100 parts of a polymerizable monomer mixture (Tg of the copolymer obtained by copolymerizing these monomers=55 C.) composed of 80.5 parts of styrene and 19.5 parts of n-butyl acrylate, 6 parts of carbon black ("#25", trade name; product of Mitsubishi Kagaku Co., Ltd.), 1 part of a charge control agent ("SPIRON Black TRH", trade name; product of Hodogaya Chemical Co., Ltd.), 0.4 parts of divinylbenzene and 0.5 parts of a polymethacrylic ester macromonomer ("AA6", trade name; Tg: 94° C.; product of Toagosei Chemical Industry Co., Ltd.) were stirred and mixed by means of an ordinary stirrer, the mixture was uniformly dispersed by means of a media type dispersing machine. Ten parts of dipentaerythritol hexamyristate (solubility=at least 10 g; maximum endothermic peak temperature=63° C.; molecular weight=1514; acid value=0.5 mg KOH/g) were added thereto, and mixed and dissolved therein to obtain a polymerizable monomer composition (liquid mixture). The preparation of all polymerizable monomer compositions was conducted at room temperature (about 23° C.).

(2) Preparation of Aqueous Dispersion Medium:

An aqueous solution with aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metallic salt) dissolved in 250 parts of ion-exchanged water under stirring to prepare a dispersion of magnesium hydroxide colloid (colloid of hardly water-soluble metal hydroxide). The preparation of all dispersions was conducted at room temperature. The droplet diameter distribution of the colloid formed was measured by means of an SALD particle diameter distribution meter (manufactured by Shimadzu Corporation) and found to be 0.36 μm in terms of $D_{50}$ (50% cumulative value of number droplet diameter distribution) and 0.80 μm in terms of $D_{90}$ (90% cumulative value of number droplet diameter distribution).

(3) Droplet-forming Step:

The polymerizable monomer composition obtained in the step (1) was poured into the colloidal dispersion of magnesium hydroxide obtained in the step (2), and the mixture was stirred until droplets became stable. After 5 parts of t-butyl peroxy-2-ethylhexanoate ("PERBUTYL 0", trade name, product of Nippon Oil & Fats Co., Ltd.) were added as a polymerization initiator thereto, the resultant dispersion was stirred 10 minutes at 15,000 rpm under high shearing force by means of an Ebara Milder (MDN303 Model, manufactured by Ebara Corporation) to form droplets of the polymerizable monomer composition.

(4) Suspension Polymerization:

A reactor equipped with an agitating blade was charged with the aqueous dispersion containing the droplets of the polymerizable monomer composition prepared in the step (3) to initiate a polymerization reaction at 90° C. and continue the reaction for 10 hours. After completion of the polymerization, the reaction mixture was cooled with water. While stirring the aqueous dispersion of polymer particles obtained by the polymerization reaction at room temperature, the pH of the system was adjusted to 4.0 or lower with sulfuric acid to conduct acid washing (at 25° C. for 10 minutes). After the thus-treated dispersion was filtered to separate water, 500 parts of ion-exchanged water were newly added to prepare a slurry again to conduct water washing. Thereafter, dehydration and water washing were conducted again several times repeatedly at room temperature, and solids were separated by filtration and then dried at 40° C. for a day by a dryer to obtain polymer particles.

The polymer particles thus obtained had a volume average particle diameter (dv) of 6.1 μm and a ratio of the volume average particle diameter (dv) to the number average particle diameter (dp) of 1.30. An endothermic peak attributable to dipentaerythritol hexamyristate appeared at 63° C. in DSC measurement.

(5) Preparation of Developer:

To 100 parts of the polymer particles obtained in the step (4), were added 0.6 parts of colloidal silica ("RX-200", trade name; product of Nippon Aerosil Co., Ltd.) subjected to a hydrophobicity-imparting treatment at room temperature, and they were mixed by means of a Henschel mixer to prepare a non-magnetic one-component developer (hereinafter may be referred to as "toner" merely). The volume resistivity of the toner thus obtained was measured and found to be 11.3 (log Ω·cm).

(6) Properties of Developer:

The fixing temperature of the toner obtained in the step (5) was measured and found to be 140° C. The shelf stability and flowability of this toner were very good. The results are shown in Table 1. Besides, evaluation as to image quality revealed that images high in image density, free of fog and irregularity and extremely good in resolution were obtained.

Example 2

Polymer particles and a toner were obtained in the same manner as in Example 1 except that the softening agent in Example 1 was changed from dipentaerythritol hexamyristate to dipentaerythritol hexapalmitate (solubility=at least 5 g; maximum endothermic peak temperature=67° C.; molecular weight=1682; acid value=1.0 mg KOH/g). The results are shown in Table 1. Evaluation as to image quality using the toner thus obtained revealed that images high in image density, free of fog and irregularity and extremely good in resolution were obtained.

Example 3

(1) Preparation of Core Particles:

The steps (1) and (2) were conducted in the same. manner as in Example 1 except that 5 parts of a yellow pigment ("Toner Yellow HG VP2155", trade name; product of Clariant Co.) were used as a colorant in place of the carbon black, and dipentaerythritol hexalaurate (solubility=at least 10 g; maximum endothermic peak temperature=56° C.; molecular weight=1346; acid value=0.5 mg KOH/g) was used as the softening agent in place of dipentaerythritol hexamyristate.

Thereafter, the resultant dispersion was stirred 30 minutes at 15,000 rpm under high shearing force by means of an Ebara Milder (MDN303V Model, manufactured by Ebara Corporation) to form droplets of the polymerizable monomer composition.

The thus-prepared aqueous dispersion containing droplets of the polymerizable monomer composition was charged into a reactor equipped with an agitating blade to initiate a polymerization reaction at 60° C. At the time the conversion of the monomer into a polymer reached almost 100%, sampling was conducted to measure the particle diameter of core particles formed. As a result, the volume average particle diameter (dv) of the core particles was 6.2 μm, and a ratio of the volume average particle diameter (dv) to the number average particle diameter (dp) was 1.23.

(2) Formation of Shell:

Two parts of methyl methacrylate (calculated Tg of the resulting polymer=105° C.) and 30 parts of water were subjected to a finely dispersing treatment by an ultrasonic emulsifier at room temperature, thereby obtaining an aqueous dispersion of a polymerizable monomer for shell. The droplet diameter of droplets of the polymerizable monomer for shell was found to be 1.6 μm in terms of $D_{90}$ as determined by means of the SALD particle diameter distribution measuring device.

The polymerizable monomer for shell and 0.2 parts of a water-soluble initiator (ammonium persulfate, product of Mitsubishi Gas Chemical Company, Inc.) were dissolved in 65 parts of distilled water, and this solution was charged into the reactor to continue the polymerization for 4 hours. The reaction was stopped to obtain an aqueous dispersion of polymer particles having a pH of 9.5.

While stirring the aqueous dispersion of the core-shell type polymer particles obtained above at room temperature, the pH of the system was adjusted to 4.0 or lower with sulfuric acid to conduct acid washing (at 25° C. for 10 minutes). After the thus-treated dispersion was filtered to separate water, 500 parts of ion-exchanged water were newly added to prepare a slurry again to conduct water washing. Thereafter, dehydration and water washing were conducted again several times repeatedly at room temperature, and solids were separated by filtration and then dried at 45° C. for a day by a dryer to recover polymer particles.

(3) Properties of Core-shell Type Polymer Particles:

The polymer particles thus obtained had a volume average particle diameter (dv) of 6.2 μm and a ratio of the volume average particle diameter (dv) to the number average particle diameter (dn) of 1.24. The thickness of the shell calculated out from the amount of the polymerizable monomer for shell used and the particle diameter of the core particles was 0.02 μm. An endothermic peak appeared at 59° C. in DSC measurement.

(4) Preparation of Developer:

To 100 parts of the polymer particles obtained in the step (3), were added 0.6 parts of colloidal silica ("RX-200", trade name; product of Nippon Aerosil Co., Ltd.) subjected to a hydrophobicity-imparting treatment at room temperature, and they were mixed by means of a Henschel mixer to prepare a non-magnetic one-component developer (toner). The volume resistivity of the toner thus obtained was measured and found to be 11.5 (log Ω·cm).

The fixing temperature of the toner obtained above was measured and found to be 135° C. The shelf stability and flowability of this toner were very good. The results are shown in Table 1. Besides, evaluation as to image quality revealed that images high in image density, free of fog and irregularity and extremely good in resolution were obtained.

Comparative Example 1

An experiment was performed in the same manner as in Example 1 except that stearyl stearate (solubility not lower than 5 g, but not higher than 10 g; maximum endothermic peak temperature=63° C.; molecular weight=536; acid value=4.0 mg KOH/g) was used as the softening agent in place of dipentaerythritol hexamyristate in Example 1. The shelf stability of the toner was as high as 65%, and this toner was hence not suitable for practical use. The: durability test was performed. As a result, filming occurred in the durability test, and fog appeared on at least 15 sheets among 12,000 sheets. The results are shown in Table 1.

TABLE 1

| | Ex. 1 | Ex. 2 | Ex. 3 | Comp. Ex. 1 |
|---|---|---|---|---|
| Softening agent: | | | | |
| Kind | Dipentaerythritol hexamyristate | Dipentaerythritol hexapalmitate | Dipentaerythritol hexalaurate | Stearyl stearate |
| Molecular weight | 1514 | 1682 | 1346 | 536 |
| Solubility (g/100 g ST; 25° C.) | ≧10 | ≧5 | ≧10 | 5–10 |
| Acid value (mg KOH/g) | 0.5 | 1.0 | 0.5 | 4.0 |
| Endothermic peak temp. (° C.) | 63 | 67 | 56 | 63 |
| Amount added (part) | 10 | 10 | 10 | 10 |
| Properties of toner: | | | | |
| dv (μm) | 6.1 | 6.2 | 6.2 | 6.8 |
| dv/dp | 1.30 | 1.28 | 1.24 | 1.39 |
| Thickness of shell (μm) | — | — | 0.02 | — |
| Volume resistivity (logΩ · cm) | 11.3 | 11.2 | 11.5 | 11.2 |
| Properties of developer: | | | | |
| Fixing temperature (° C.) | 140 | 140 | 140 | 145 |
| Shelf stability (%) | 8 | 5 or lower | 4 | 65 |
| Flowability | 65 | 62 | 76 | 38 |
| Image quality: | | | | |
| H/H (sheets) | ≧10,000 | ≧10,000 | ≧10,000 | ≧10,000 |
| L/L (sheets) | ≧10,000 | ≧10,000 | ≧10,000 | ≧10,000 |
| Durability (sheets) | ≧20,000 | ≧20,000 | ≧20,000 | 12,000* |

*Discarded any fractional sum less than 1,000 sheets.

INDUSTRIAL APPLICABILITY

According to the present invention, there can be provided toners for development of electrostatic images, which have a low fixing temperature, can meet energy saving, the speeding-up of printing and copying, the formation of full-color images, and the like, has excellent shelf stability and flowability and permit forming images high in resolution and good in image quality.

The toners according to the present invention have a low-fixing temperature and good offset resistance, are excellent in shelf stability and can be suitably applied to image forming apparatus for high-speed printing, and the like.

What is claimed is:

1. A toner for development of electrostatic images, comprising colored particles containing at least a binder resin, a colorant and a softening agent, wherein the softening agent is an organic compound having:

(A) a molecular weight of 1,000 to 1,800, (B) a solubility of at least 5 g in 100 g of styrene as measured at 25° C., and (C) an acid value of at most 10 mg KOH/g, and wherein the organic compound is a polyfunctional ester compound which is a condensate of a polyhydric alcohol having a functionality of at least 5 and a carboxylic acid having 13 to 25 carbon atoms.

2. The toner for development of electrostatic images according to claim 1, wherein the softening agent is an organic compound having:

(B1) a solubility of 5 to 25 g in 100 g of styrene as measured at 25° C., and (C1) an acid value of 0.01 to 10 mg KOH/g.

3. The toner for development of electrostatic images according to claim 1, wherein the softening agent is a low-softening point substance exhibiting a maximum endothermic peak temperature in a range of 50 to 80° C. upon heating thereof in a DSC curve determined by a differential scanning calorimeter.

4. The toner for development of electrostatic images according to claim 1, wherein the polyhydric alcohol is dipentaerythritol.

5. The toner for development of electrostatic images according to claim 1, wherein the carboxylic acid is at least one carboxylic acid selected from the group consisting of myristic acid and palmitic acid.

6. The toner for development of electrostatic images according to claim 1, wherein the polyfunctional ester compound is at least one selected from the group consisting of dipentaerythritol hexamyristate and dipentaerythritol hexapalmitate.

7. The toner for development of electrostatic images according to claim 1, which has a core-shell structure that colored particles containing at least the binder resin, the colorant and the softening agent serve as a core, and a polymer layer covering the core is formed.

8. A process for producing a toner for development of electrostatic images, comprising the step of subjecting apolymerizable monomer composition containing at least a polymerizable monomer, a colorant and a softening agent to suspension polymerization in an aqueous dispersion medium containing a dispersion stabilizer, said process comprising using, as the softening agent, an organic compound having:

(A) a molecular weight of 1,000 to 1,800, (B) a solubility of at least 5 g in 100 g of styrene as measured at 25° C., and (C) an acid value of at most 10 mg KOH/g, and wherein the organic compound is a polyfunctional ester compound which is a condensate of a polyhydric alcohol having a functionality of at least 5 and a carboxylic acid having 13 to 25 carbon atoms.

9. The production process according to claim 8, wherein an organic compound having:

(B 1) a solubility of 5 to 25 g in 100 g of styrene as measured at 25° C., and (C1) an acid value of 0.01 to 10 mg KOH/g is used as the softening agent.

10. The production process according to claim 8, wherein the softening agent is a low-softening point substance exhibiting a maximum endothermic peak temperature in a range of 50 to 80° C. upon heating thereof in a DSC curve determined by a differential scanning calorimeter.

11. The production process according to claim 8, wherein the polyhydric alcohol is dipentaerythritol.

12. The production process according to claim 8, wherein the carboxylic acid is at least one carboxylic acid selected from the group consisting of myristic acid, and palmitic acid.

13. The production process according to claim 8, wherein the polyfunctional ester compound is at least one selected from the group consisting of dipentaerythritol hexamyristate and dipentaerythritol hexapalmitate.

14. The production process according to claim 8, wherein said step of subjecting a polymerizable monomer composition containing at least a polymerizable monomer, a colorant and a softening agent to suspension polymerization is performed to form colored particles composed of polymer particles containing the colorant, and further comprising the step of polymerizing a polymerizable monomer capable of forming a polymer having a glass transition temperature higher than that of the polymer component forming the colored particles in the presence of the colored particles, thereby forming core-shell type polymer particles that a polymer layer covering each of the colored particles is formed.

* * * * *